US006036028A

United States Patent [19]

Jungmann et al.

[11] Patent Number: 6,036,028

[45] Date of Patent: Mar. 14, 2000

[54] APPARATUS FOR SEPARATING OFF LIGHT MATERIALS FROM SAND AND GRAVEL

[75] Inventors: Andreas Jungmann, Essen; Walter Strangalies, Altenholz; Thomas Neumann, Düsseldorf, all of Germany

[73] Assignee: Allmineral Aufbereitungstechnik GmbH & Co. KG, Germany

[21] Appl. No.: 09/068,216

[22] PCT Filed: Oct. 29, 1996

[86] PCT No.: PCT/DE96/02081

§ 371 Date: Jun. 12, 1998

§ 102(e) Date: Jun. 12, 1998

[87] PCT Pub. No.: WO97/16253

PCT Pub. Date: May 9, 1997

[30] Foreign Application Priority Data

Nov. 2, 1995 [DE] Germany ..... 195 40 644

[51] Int. Cl.[7] ..... B04C 5/12; B03D 5/60; B03B 7/00

[52] U.S. Cl. ..... 209/732; 209/208; 209/210; 209/726; 209/18; 209/733

[58] Field of Search ..... 209/17, 18, 208, 209/209, 210, 726, 732

[56] References Cited

U.S. PATENT DOCUMENTS

| | | | |
|---|---|---|---|
| 3,061,098 | 8/1962 | Brezinski | 209/17 |
| 3,905,894 | 9/1975 | Hukki | 209/17 |
| 4,253,942 | 3/1981 | Gaumann | 209/17 |
| 4,352,732 | 10/1982 | Massicotte | 209/17 |
| 5,074,719 | 12/1991 | Davies | 406/173 |

FOREIGN PATENT DOCUMENTS

| | | | |
|---|---|---|---|
| 243721 | 11/1965 | Austria . | |
| 0423964 | 4/1991 | European Pat. Off. . | |
| 0508335 | 10/1992 | European Pat. Off. . | |
| 3427395 | 2/1986 | Germany . | |
| 645704 | 8/1979 | U.S.S.R. | 209/17 |
| 9319851 | 10/1993 | WIPO . | |

OTHER PUBLICATIONS

"Eindick–und Klassiervorrichtung"; Apr. 22, 1965; pp. 1–9; Dr. Hubert Heigl.

*Primary Examiner*—Donald P. Walsh
*Assistant Examiner*—Daniel K Schlak
*Attorney, Agent, or Firm*—Robert W. Becker & Associates

[57] ABSTRACT

An apparatus for separating out light materials from mineral raw materials is provided. The apparatus includes a charging device that has a charging tube provided with an eccentrically arranged inlet for tangential introduction of raw material. The apparatus also has an inner chamber for separating out coarse sand received from the charging tube, and an outer chamber that serves for sorting out fine sand pursuant to the fluidized bed process. The outer chamber communicates with an overflow chute of the charging tube via an inclined overflow surface. An impingement body is centrally disposed in the inner chamber while leaving free an outer annular gap. The charging tube opens out centrally above the impingement body. A perforated basket, for adjusting flow resistance, is disposed so as to be displaceable in the axis of the charging tube and bridges a space between the impingement body and the end of the charging tube. The overflow chute of the charging tube is provided at that end thereof remote from the impingement body. As a function of a separation particle size setting of the charging device, which is adjusted by displacement of the perforated basket, the overflow chute communicates either with the outer chamber or with a light material overflow associated therewith.

5 Claims, 3 Drawing Sheets

APPARATUS FOR SEPARATING OFF LIGHT MATERIALS FROM SAND AND GRAVEL

BACKGROUND OF THE INVENTION

The present invention relates to an apparatus for separating out light materials from mineral raw materials, especially from sand and gravel, and includes a charging means for the raw material, an inner chamber, as a coarse sand chamber, for separating out the coarse sand, and with an outer chamber, as a fine sand chamber, that serves for the sorting out of the fine sand pursuant to the fluidized bed process, with this outer chamber communicating with the coarse sand chamber via an overflow embodied as an inclined surface, as well as an overflow for the light materials associated with the outer chamber, whereby the charging means includes a charging tube that ends centrally above an impingement body that is centrally disposed in the inner chamber and leaves free an outer annular gap.

An apparatus of this general type is described in EP 0 508 335 A2; by means of the configuration described therein, the known apparatus intends to avoid the pretreatment of the raw material charge, so that it is possible to directly supply the raw material coming from the extraction or the screening into the separating apparatus. However, in doing so large quantities of water in the charge can have a disadvantageous effect, since such large quantities of water cause great hydraulic stress of the coarse sand chamber and therefore either material that is too coarse is transported into the fine sand chamber or fine sand substituents are carried along beyond the fine sand chamber into the light material overflow.

It is therefore an object of the present invention to improve an apparatus having the aforementioned features such that larger quantities of water that pass, even in an abrupt manner, into the separating apparatus with the material charge can be managed without having an adverse effect upon the separation success of the apparatus.

SUMMARY OF THE INVENTION

The realization of this object, including advantageous configurations and embodiments of the invention, result from the content of the patent claims that follow this specification.

The basic concepts of the invention are that a charging tube has an eccentrically arranged inlet for the tangential introduction of the raw material charge, and at its end remote (opposite) from the impingement body the charging tube has an overflow chute, and a perforated basket, for adjusting the flow resistance, bridges the space between the end of the charging tube and the impingement body, with the perforated basket being displaceable in the tube axis, whereby depending upon the precision of separation or separation particle size of the overflow of the charging means, which is adjusted by modifying the position of the perforated basket, the overflow chute communicates either with the fine sand chamber or with the light material overflow.

The present invention has the advantage that due to the configuration of the raw material inlet in the manner of a cyclone, a separation of the overflow water including fine and very fine particles results; the particle size of the solid material particles that pass into the overflow chute with the overflow water is adjustable by means of the perforated basket that is additionally disposed between the end of the charging tube and the impingement body, whereby with the help of the impingement body the flow resistance for the raw material charge can be regulated as a measure for the counter pressure that fixes the interface (for separation particle size) of the inlet, which has a cyclone-type configuration. Depending upon the setting of the interface for the cyclone-type inlet, the overflow chute can be connected either with the fine sand region, which results in the advantage that a good production is provided with a partial relief of the coarse sand chamber from the fine sand charge, or the overflow chute can communicate directly with the light material overflow so that the overflow water, including the sludge-like very fine substituents, is directly drawn off accompanied by relief not only of the coarse sand chamber but also of the fine sand chamber.

To the extent that the overflow chute is connected to the fine sand chamber, it is provided pursuant to one specific embodiment of the invention that the overflow chute be connected to that end of an inclined overflow surface between the inner chamber and the outer chamber that faces the coarse sand chamber.

To the extent that pursuant to the present invention a communication of the overflow chute with the fine sand chamber is to be effected, it is proposed pursuant to another specific embodiment of the present invention, to avoid a hydraulic over stressing of the fine sand chamber with an overflowing of fine sand into the light material overflow, to provide a sedimentation region between the overflow chute of the charging means and the inclined overflow surface disposed between the inner chamber and the outer chamber, with the sedimentation region having a chute surface that adjoins the overflow chute and is inclined downwardly in a direction toward the overflow surface, as well as with a plurality of parallel plates that extend at an angle to the chute surface and essentially perpendicular to the direction of flow of the overflow, whereby the last plate as viewed in the direction of flow of the overflow is embodied as an overflow with a connection to the light material overflow; this has the advantage that in the sedimentation region a separation of fine sand fraction from the overflow water as well as from the sludge-like very fine substituents is effected so that therewith the production of fine sand continues to be ensured, even with a large supply of water in the raw material charge. In this way, two partial streams flow together on the inclined overflow surface between the coarse sand chamber and the fine sand chamber, so that the overall fine sand fraction in the raw material charge is conveyed over the fluidized bed stage that serves for the fine sand sorting.

Pursuant to one specific embodiment of the invention, those ends of the individual plates that face the chute surface each have the same spacing relative to the chute surface, and the opposite ends of the plates are disposed in a horizontal plane and are encased by a housing that is spaced therefrom.

To the extent that in one specific embodiment of the invention the fine sand chamber and the light material overflow surround the centrally disposed coarse sand chamber with its charging means in an annular manner, it is proposed that while maintaining the symmetrical, circular configuration of the overall apparatus, the overflow chute and sedimentation region with the chute surface be circularly disposed and the plates be disposed in a radial position and circular path.

BRIEF DESCRIPTION OF THE DRAWINGS

Specific examples of the invention are shown in the drawings, which are described subsequently. Shown are.

DESCRIPTION OF PREFERRED EMBODIMENTS

Figure 1:
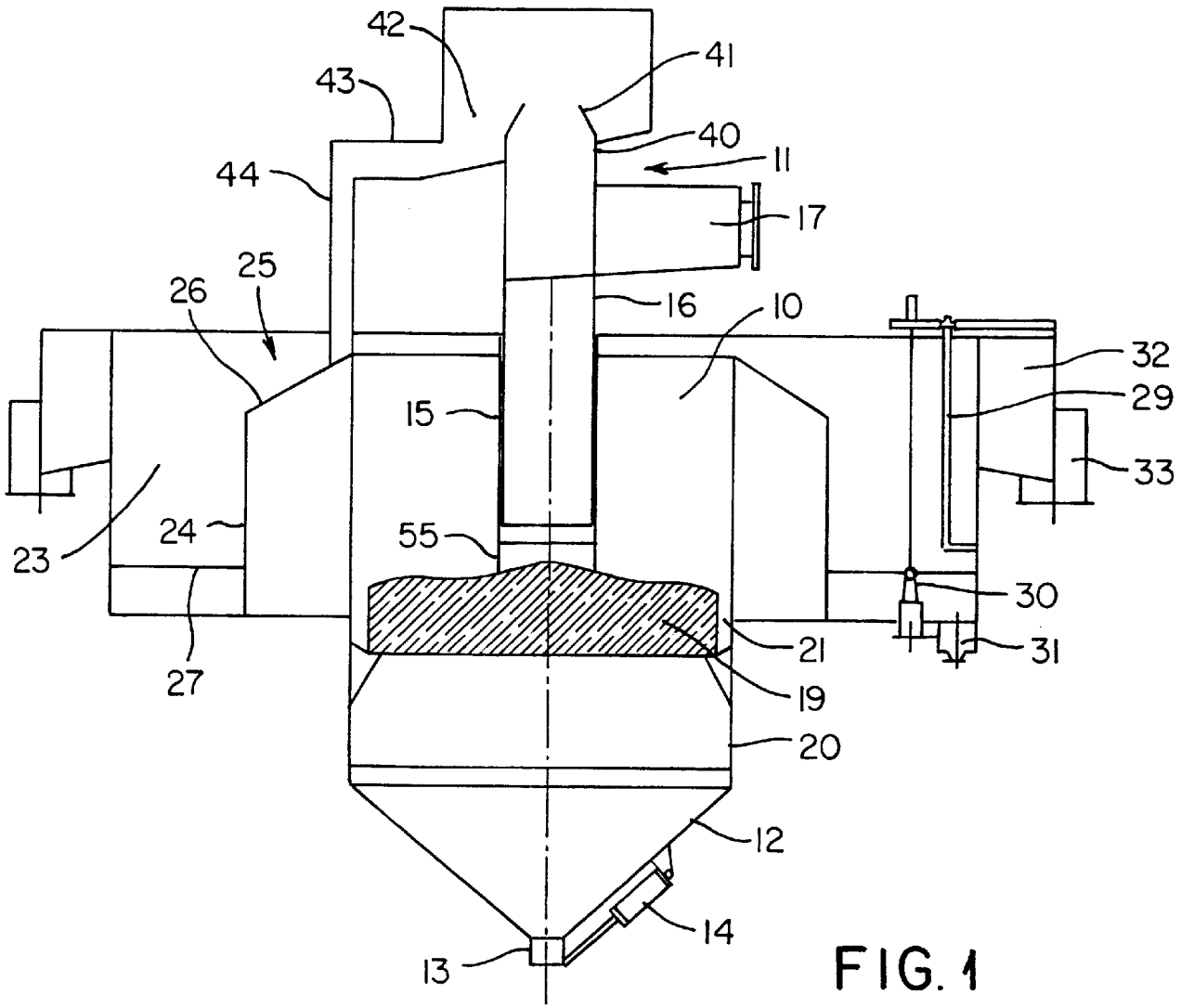
FIG. 1 a cross-sectional view of a separating apparatus.

As already described in the state of the art EP 0 508 335 A2, the separating apparatus comprises a cylindrical inner chamber 10 having a loading device or charging means 11. The lower end of the inner chamber 10 is provided with a conically tapering discharge region 12 that has a controllable outlet 13, which is actuateable via a mechanism 14; though not illustrated, disposed on the outer periphery of the inner chamber 10 are feed lines for supplying tail water.

Annularly surrounding the inner chamber 10, and spaced therefrom, is an outer chamber 23, the inner wall 24 of which surrounds and is spaced from the outer wall 20 of the inner chamber 10. This spacing between the inner chamber 10 and the outer chamber 23 is bridged by an overflow that is embodied as an overflow surface 26 that is inclined toward the outer chamber 23. Disposed in the outer chamber 23 is a base 27 that in a non-illustrated manner comprises individual segments, whereby each individual segment of the base 27 is provided with a discharge member 30 that is controlled by a mechanism 29 or associated electronics. The outer chamber 23 is furthermore provided with an intake 31 for the required tail water. Adjoining the upper rim of the outer chamber 23 is an overflow 32 having an outlet 33 for the overflow water and the light materials that have been flushed out.

The charging means 11 comprises a loading or charging tube 15 that is disposed centrally over the inner chamber 10 and is arranged so as to be longitudinally displaceable. In the illustrated embodiment, a feed tube 16 is disposed within the charging tube 15 and is provided with an inlet 17 that is disposed eccentrically relative to the central axis of the feed tube for the tangential introduction of raw material.

Disposed centrally in the inner chamber 10 below the charging tube 15 is an impact or impingement body 19 that while being generally inclined has an outer surface that is wave-shaped. An annular gap 21 remains between the outer wall 20 of the inner chamber and the impingement body 19. Furthermore, disposed between the end of the feed tube 16 and the impingement body 19 is an apertured or perforated basket 55 that is adjustably mounted in order to set a gap between the perforated basket 55 and the impingement body 19; by means of the perforated basket, the flow resistance and hence separation particle size for the raw material discharge exiting the feed tube 16 can be regulated.

Figure 2:
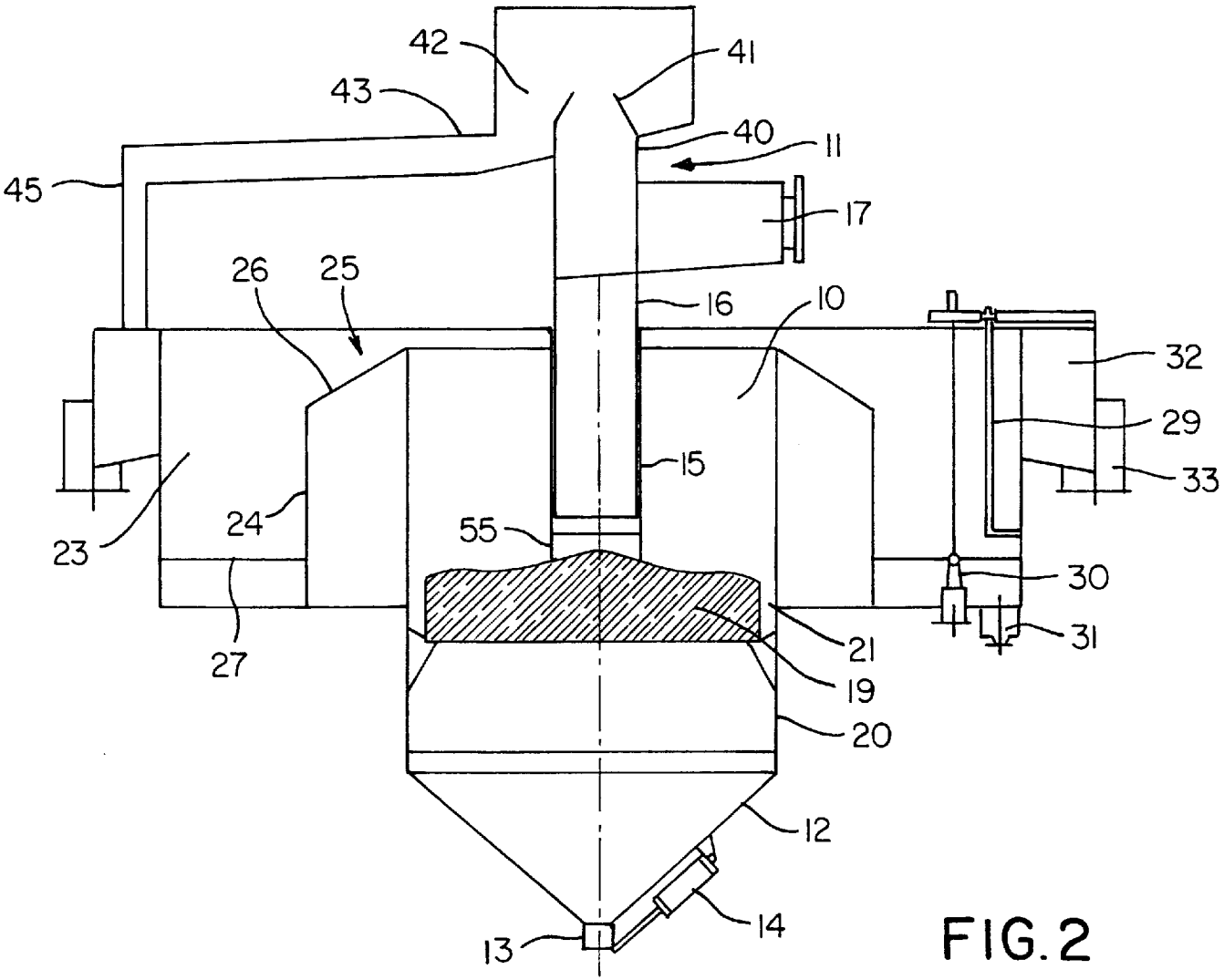
FIG. 2 another exemplary embodiment of the separating apparatus of FIG. 1, FIG. 3 a further exemplary embodiment of the separating apparatus of FIG. 1 with overflow sedimentation.
Figure 3:
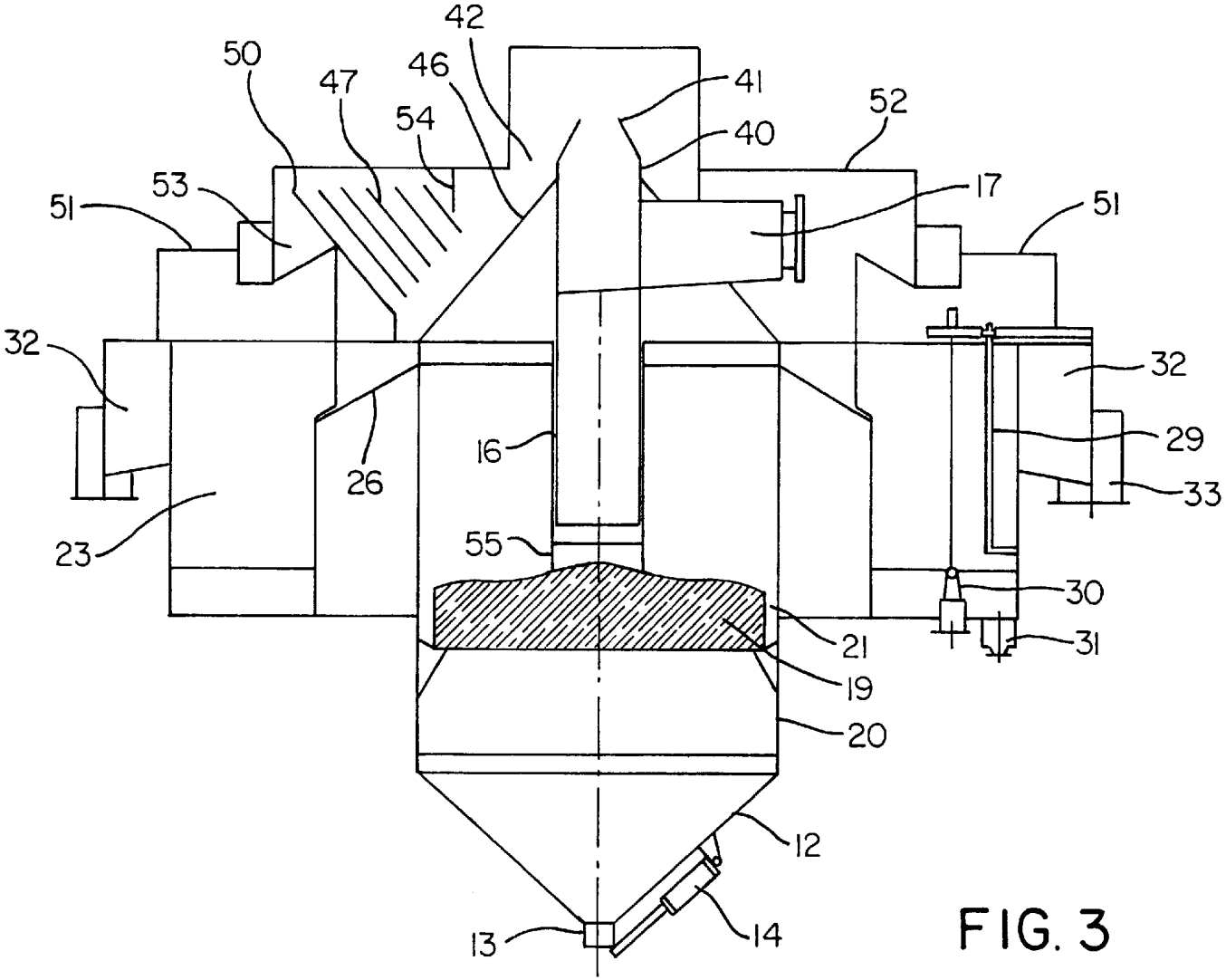

In the embodiments illustrated in FIGS. 1 to 3, the feed tube 16, which is displaceably disposed in the charging tube 15, is provided above the inlet 17 with an extension 40, at the end of which an overflow edge 41 forms the overflow into a spillway or overflow chute 42; connected to the overflow chute 42 is a pipe connection 43 from which, in the embodiment illustrated in FIG. 1, a conduit 44 leads to the overflow surface 26 that is disposed between the inner chamber 10 and the outer chamber 23, whereas in the embodiment illustrated in FIG. 2, a conduit 45 leads from the pipe connection 43 to the light material overflow 32.

During operation of the inventive apparatus illustrated in FIGS. 1 and 2, the feeding of the raw material charge is effected via the inlet 17, which is eccentrically disposed on the feed tube 16, so that due to the tangential introduction speed there results in the feed tube 16 a cyclone effect; the separation grain or particle size of this cyclone-type charging mechanism is achieved via the adjustable perforated basket 55 because thereby a flow resistance into the inner chamber 10 can be regulated; with this flow resistance, the counter pressure to the tangential introduction speed of the raw material charge is produced, from which the interface (for separation particle size) results in the region of the charging means 11. Thus, the excess or overflow water, with the solid constituents contained therein, flows over the overflow edge 41 into the overflow chute 42 and from there to the two pipe connections 43.

If for example the separation or cutoff particle size in the charging means 11 is set at approximately 0.5 mm, which at the same time corresponds to the separation particle size between the coarse sands and the fine sands, the overflow water with the fine sand constituents will pass to the pipe connection 43; the rest of the raw material charge passes via the feed tube 16 onto the impingement body 19 and is distributed thereover until it reaches the annular gap 21, where depending upon the flow velocity that is set there, a particle size separation of the raw material charge at a particle size between 2 mm and approximately 0.5 mm results.

The coarse sands having a particle size of greater than 0.5 mm sink into the discharge region 12 of the inner chamber 10 (the coarse sand region) and are discharged via the outlet 13 in regulated form. The fine sands having a particle size of less than 0.5 mm, and the organic contaminants contained therein, especially carbonized wood, follow the upwardly directed flow in the inner chamber 10 and pass onto the inclined overflow surface 26; in the embodiment illustrated in FIG. 1, the conduit 44 from the pipe connection 43 also opens out at this location, so that the overflow water with further fine sand constituents having a particle size of less than 0.5 mm are also guided onto the overflow surface 26; a sedimentation is effected on the surface 26 that involves a certain preliminary thickening, so that fine sands containing contamination pass from the overflow surface 26 in an already prelayered form into the sorting region of the outer chamber 23 that operates pursuant to the fluidized bed process.

In a known manner, there is effected above the base 27 disposed in the outer chamber 23 the generation of the fluidized bed in order to separate the organic impurities and the very fine constituents still contained in the fine sands from the fine sands and to separate them off via the overflow 32 having the outlet 33. The cleaned fine sands are withdrawn via the discharge members 30 disposed in individual segments of the base 27.

In the embodiment illustrated in FIG. 2, a conduit connection 45 is established between the pipe connection 43 and the light material overflow 32, as a result of which a separation particle size in the region of the charging means 11, which operates in the manner of a cyclone, over the perforated basket 55 can be considerably below 0.5 mm, because then the overflow water is merely separated off with very fine particle constituents, so that it can be conveyed directly to the final overflow of the separating apparatus.

In the embodiment illustrated in FIG. 3, the separation of the overflow water with a fine sand fraction having a particle size of less than 0.5 mm is effected in the charging means 11 that operates in the manner of a cyclone, whereby the overflow of the charging means 11 is conveyed to the fine sand region via the overflow surface 26 that is disposed between the coarse sand chamber (inner chamber 10) and the fine sand chamber (outer chamber 23). Disposed between the overflow chute 42 of the charging means 11 and the overflow surface 26 is a sedimentation region in which a separation of the overflow water from the fine sands is undertaken. For this purpose, an inclined chute surface 46 is disposed between the overflow chute 42 and the overflow surface 26; in the space above the chute surface 46 and enclosed by a housing 52 there is disposed a plurality of parallel plates 47 that are disposed at an angle to the chute surface 46 and essentially perpendicular to the direction of flow of the overflow water that contains fine sand and is separated off in the charging means; the plates 47 are fixed in position at a distance from one another, whereby those ends of the individual plates 47 that face the chute surface 46 respectively have the same spacing relative to the chute surface 46; the opposite ends of the plates 47 end in a horizontal plane, so that the individual plates 47 have a length that increases in the direction of flow of the overflow that is to be clarified. In conformity with the configuration of the separating apparatus of FIGS. 1 and 2, which have an annular arrangement of the fine sand chamber with light material overflow about the centrally disposed coarse sand chamber, with the embodiment of FIG. 3 the overflow chute 42 and the sedimentation region with chute surface 46 and plates 47 have a circular configuration, whereby the plates 47 are positioned radially and have a circular path.

Disposed upstream of the first plate 47 as viewed in the direction of flow is a partition 54 to guide the overflow that is to be clarified onto the chute surface 46, whereby the last plate 47 as viewed in the direction of flow forms an overflow edge 50 that is adjoined by a collection chamber 53 for the clarified water that now contains only sludge constituents, with a conduit 51 leading from the collection chamber to the light material overflow 32.

With the above described embodiment, the overflow water with fine sand fraction separated off in the charging means 11 flows over the chute surface 46, whereby a sedimentation and separation of the overflow water with the fine sand constituents is effected in that the water rises between the individual plates 47, whereby the fine sand constituents are separated from the water or residual sludge and pass via the chute surface 46 onto the overflow surface 26 and from there out into the fine sand chamber (outer chamber 23); the separated-off overflow of water with sludge-like very fine constituents passes via the overflow edge 50 and via the conduit 51 directly into the light material overflow 32.

The features of the subject matter of this document disclosed in the above specification, the patent claims, and the abstract can be important individually or also in any combination with one another for realizing the various embodiments of the invention.

The specification incorporates by reference the disclosure of German priority document 195 40 644.3 of Nov. 2, 1995. and PCT/DE96/02081 of Oct. 29, 1996.

The present invention is, of course, in no way restricted to the specific disclosure of the specification and drawings, but also encompasses any modifications within the scope of the appended claims.

We claim:

1. An apparatus for separating out light materials from mineral raw materials, comprising:

charging means for raw material, including a charging tube that is provided with an eccentrically arranged inlet for tangential introduction of raw material;

an inner chamber, as a coarse sand chamber, for separating out coarse sand received from said charging tube of said charging means;

an outer chamber, as a fine sand chamber, that serves for sorting out fine sand pursuant to the fluidized bed process, wherein said outer chamber communicates with an overflow chute of said charging tube via a first overflow in the form of an inclined surface;

a second overflow associated with said outer chamber for light materials;

an impingement body centrally disposed in said inner chamber such that an annular gap is provided between an outer periphery of said impingement body and an inner wall of said inner chamber, said charging tube opening out centrally above said impingement body; and a perforated basket, for adjusting flow resistance, and hence separation particle size, disposed so as to be displaceable in an axis of said charging tube and bridging a space provided between said impingement body and an opening out end of said charging tube, wherein said overflow chute of said charging tube is provided at an end thereof remote from said impingement body, and wherein as a function of a separation particle size setting of said charging means, which is adjusted by displacement of said perforated basket, said overflow chute communicates either with said outer chamber or with said second, light material overflow.

2. An apparatus according to claim 1, wherein said overflow chute communicates with said outer chamber, wherein said overflow chute of said charging tube is connected to an end of said inclined overflow surface that faces said inner chamber, and wherein said inclined overflow surface is disposed between said inner chamber and said outer chamber.

3. An apparatus according to claim 1, wherein said overflow chute communicates with said outer chamber, wherein a sedimentation region is disposed between said overflow chute of said charging tube and said inclined overflow surface, which is disposed between said inner chamber and said outer chamber, wherein said sedimentation region is provided with a chute surface that adjoins said overflow chute and is inclined downwardly in a direction toward said overflow surface, wherein said sedimentation region is further provided with a plurality of parallel plates that extend at an angle relative to said chute surface and essentially perpendicular to a direction of flow of overflow, and wherein that plate that is the last plate when viewed in said direction of flow of said overflow is embodied as an overflow means that communicates with said second, light material overflow.

4. An apparatus according to claim 3, wherein those edges of said plates that face said chute surface are each spaced the same distance relative to said chute surface, and wherein the opposite edges of said plates are disposed in a horizontal plane and are encased by a housing that is space therefrom.

5. An apparatus according to claim 3, wherein said inner chamber with said charging means is centrally disposed and said outer chamber and second, light material overflow annularly surround said inner chamber, wherein said overflow chute and said sedimentation region, with said chute surface, are circularly arranged, and wherein said plates are disposed in a radial position and circular path.

* * * * *